US006943741B2

(12) United States Patent
Bally et al.

(10) Patent No.: US 6,943,741 B2
(45) Date of Patent: Sep. 13, 2005

(54) AM/FM ON-GLASS WIRE GRID ANTENNA

(75) Inventors: Nazar F. Bally, Sterling Heights, MI (US); Korkut Yegin, Grand Blanc, MI (US); Randall J. Snoeyink, Clarkson, MI (US); William R. Livengood, Grand Blanc, MI (US)

(73) Assignee: Delphi Technologies, Inc., Troy, MI (US)

( * ) Notice: Subject to any disclaimer, the term of this patent is extended or adjusted under 35 U.S.C. 154(b) by 34 days.

(21) Appl. No.: 10/759,321

(22) Filed: Jan. 16, 2004

(65) Prior Publication Data

US 2005/0156798 A1 Jul. 21, 2005

(51) Int. Cl.[7] ..... H01Q 1/32

(52) U.S. Cl. ..... 343/713; 343/711

(58) Field of Search ..... 343/711, 712, 713

(56) References Cited

U.S. PATENT DOCUMENTS 5,793,333 A * 8/1998 Taniguchi et al. ..... 343/713
6,215,450 B1 * 4/2001 Oka ..... 343/713
6,870,509 B2 * 3/2005 Ooe et al. ..... 343/711

* cited by examiner

*Primary Examiner*—Shih-Chao Chen
(74) *Attorney, Agent, or Firm*—Stefan V. Chmielewski

(57) ABSTRACT

An antenna including a first FM portion and first and second AM portions. The first AM portion at least partially circumscribes the first FM portion and the second AM portion at least partially circumscribes the first AM portion and at least partially circumscribes the first FM portion.

18 Claims, 6 Drawing Sheets

AM/FM ON-GLASS WIRE GRID ANTENNA

TECHNICAL FIELD

This invention generally relates to vehicle radio antennas and more specifically relates to vehicle radio antennas which are integrated with the vehicle windows.

BACKGROUND OF THE INVENTION

In order to enhance a vehicle's aesthetic qualities, it is common to integrate the vehicle radio antennas with one or more of the vehicle's windows (commonly known as hidden antenna systems or on-glass AM/FM antenna system). Unlike mast (rod) antennas, on-glass antenna systems do not introduce any external vehicle protrusions and they typically offer excellent mechanical stability and satisfactory reception performance. Although on-glass antennas are widely used, they do suffer from various drawbacks. Specifically, on-glass antennas are difficult to design because a small change in a vehicle's body design can radically change the reception performance of the antenna.

On-glass antenna systems are usually fabricated by printing metallic conductors on an inner surface of the back-glass or the side-glass of a vehicle window. A low-noise-amplifier (LNA) circuit is typically mounted in close proximity to the on-glass antenna and is electrically coupled to the on-glass antenna to amplify the weak signal received by the antenna before it is sent to the radio receiver for further conditioning. The on-glass antennas are typically fed vertically (close to the vehicle roof) so that the LNA circuit can be housed in the vicinity where the vehicle roof intersects the window. Recently, vehicle designers have found it advantageous to place side-airbags in the locations where the LNA circuits have traditionally resided. Accordingly, new feed points for the on-glass antennas and for the placement of the LNA are required. The most obvious approach is to simply rotate the current on-glass antenna design by 90 degrees which would enable a horizontal feed from the LNA circuit to the on-glass antenna. However, this approach has been shown to tremendously degrade the reception performance of the on-glass antenna rendering its reception quality so poor that it no longer meets the performance specified by many vehicle manufacturers.

This invention sets forth various on-glass window grid antenna designs that can be fed horizontally while still maintaining excellent reception performance characteristics.

DETAILED DESCRIPTION OF PREFERRED EMBODIMENTS

Six embodiments of the present invention are included in this disclosure. Although all six of the embodiments are disclosed in conjunction with side glass implementation, it is to be understood that the embodiments are not limited to side glass implementation and that they can just as easily be implemented on the rear glass or the front windshield of a vehicle.

Figure 1:
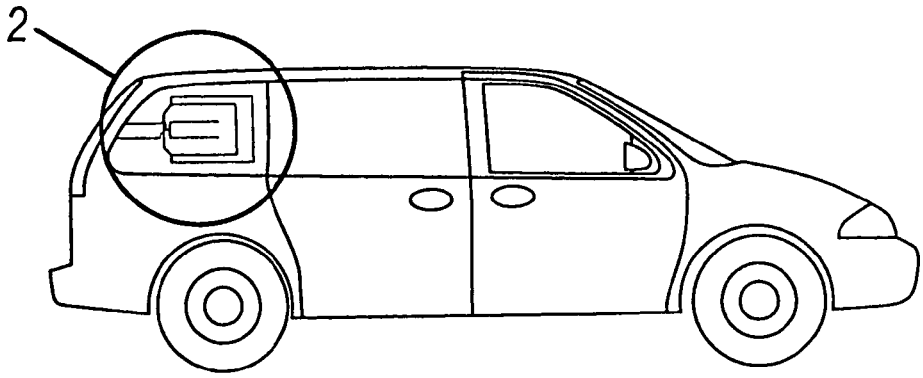
FIG. 1 is an environmental view of the on-glass antenna of the present invention.
Figure 2:
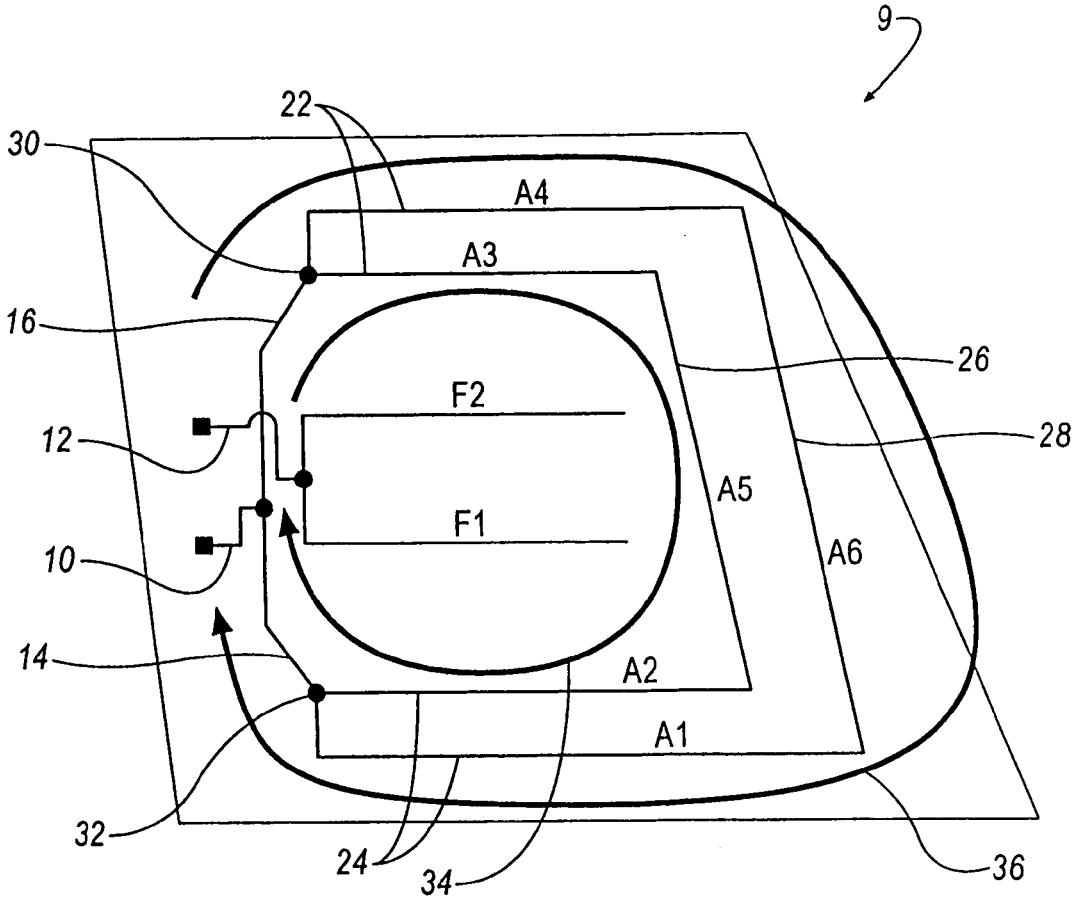
FIG. 2 is a first embodiment of the on-glass antenna of the present invention.

Now referring to FIGS. 1 and 2, in a first embodiment, the on-glass antenna of the present invention includes two main feeds 10, 12. Main feed 10 is associated with the implementation of an AM antenna and main feed 12 is associated with the implementation of an FM antenna. Main FM feed segment 12 extends generally horizontally across side glass 9 and splits into generally parallel, bifurcated forks comprising upper FM antenna segment F2 and lower FM antenna segment F1.

Main AM feed segment 10 bifurcates into first AM feed segment 14 and second AM feed segment 16. Both AM feed segments 14, 16 extend generally vertically from main AM feed 10 wherein first AM feed segment 14 extends generally downwardly from main AM feed 10 and wherein second AM feed segment 16 extends generally upwardly from main AM feed segment 10. First AM feed segment 14 branches into lower AM antenna pair 24 consisting of antenna segments A1 and A2. Second AM feed segment 16 branches into upper AM antenna pair 22 consisting of antenna segments A3 and A4. Antenna segments A1, A2 extend generally horizontally from their common branch point 32 and, likewise, antenna segments A3, A4 extend generally horizontally from their common branch point 30.

Antenna segments A2, A3 are connected to one another by way of generally vertical AM antenna connector segment A5. Antenna segments A1 and A4 are connected to one another by way of generally vertical AM antenna connector segment A6. A first, inner loop AM antenna 34 is formed from segments 16, A3, A5, A2, and 14. A second, outer loop AM antenna is formed from segments 16, A4, A6, A1, and 14. Although inner loop AM antenna 34 and outer loop AM antenna 36 share common elements 14, 16 they are also respectively comprised of non-shared elements. For example, inner loop 34 includes generally linear elements A3, A5, and A2. None of which are common to outer loop AM antenna 36. In contrast, outer loop AM antenna 36 includes, in part, antenna segments A4, A6, and A1—none of which are common to inner loop AM antenna 34. At least a portion of inner loop antenna 34 is completely contained within a portion of outer loop antenna. Specifically, antenna segments A3, A5, and A2 are circumscribed by outer loop AM antenna segments A4, A6, and A1. It is also important to note that upper FM antenna segment F2 and lower FM antenna segment F1 are completely circumscribed by both inner loop AM antenna 34 and outer loop AM antenna 36.

Although the exact causal connection is uncertain, it is speculated that the juxtaposition of FM antenna segments F1 and F2 surrounded by inner loop AM antenna 34 and outer loop AM antenna 36 gives rise to significant improvements in the reception performance of the FM antenna (12, F1, and F2). Preferably the perimeter of both inner and outer loop AM antennas 34, 36 is much smaller than the operation wave length of the FM antenna (12, F1, and F2). It is possible that the superior performance of the FM antenna is due to the combination of the horizontal FM antenna segments F1, F2 and the inner and outer loop AM antennas 34, 36 which together may provide a round linear polarization pattern which may generate a small gain difference between the maximums and minimums of the pattern.

Figure 3:
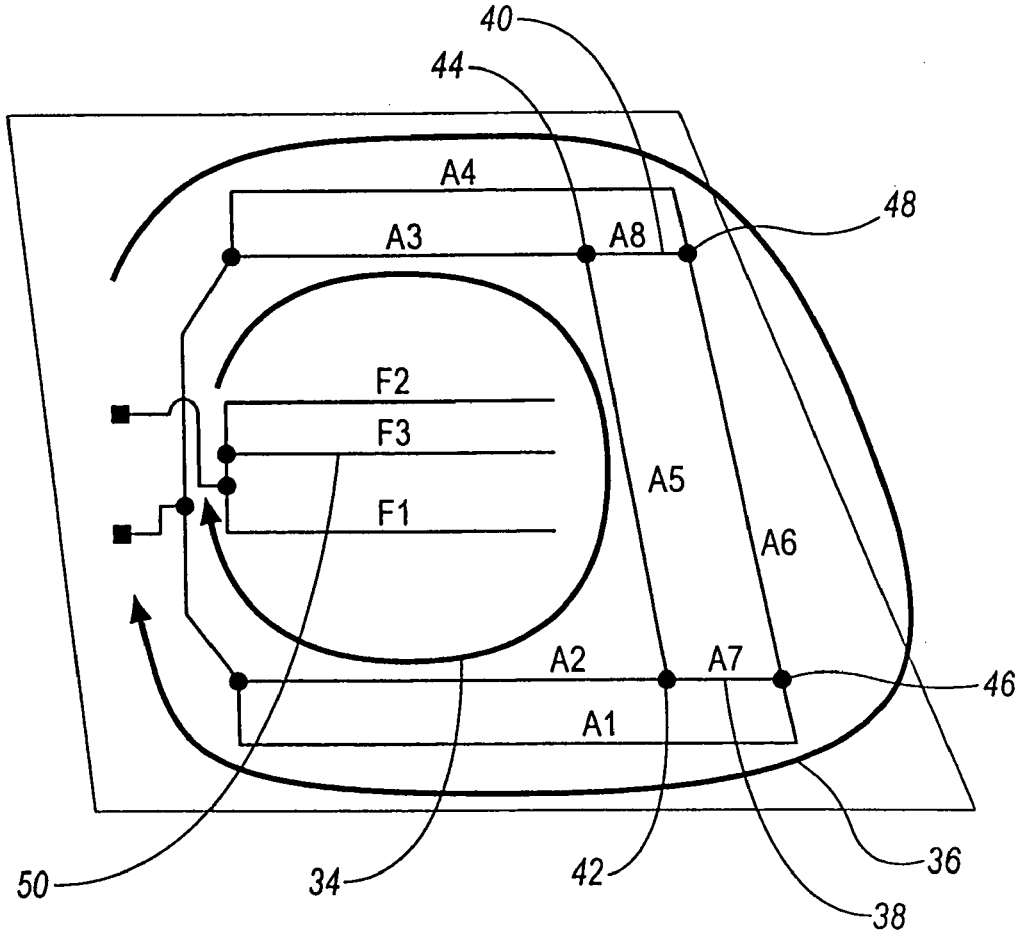
FIG. 3 is a second embodiment of the on-glass antenna of the present invention.

Now referring to FIG. 3, a second embodiment of the on-glass antenna system of the present invention include the elements and layout of the first embodiment, but in addition it includes, first and second jumper segments A7, A8 respectively. Both first and second jumper segments A7, A8 are connected between inner loop AM antenna 34 and outer loop AM antenna 36. Specifically, first and second intersections 42, 44, are respectively formed on inner loop AM antenna 34 (intersection 42 is formed at the junction of segment A2 and A5, wherein intersection 44 is formed at the junction of A3 and A5). Third and fourth intersections 46, 48 are formed along outer loop AM antenna 36. Specifically, intersection 46 is formed at the junction between segment A1 and A6 and intersection 48 is formed at the intersection of A4 and A6. First jumper segment 38 extends between first intersection 42 and third intersection 46 wherein second jumper segment 40 extends between second intersection 44 and fourth intersection 48. First and second jumper segments 38, 40 extend generally horizontally and they are generally parallel to one another. Segments A2 and A7 are generally straight segments and, in the embodiment of FIG. 3, they are co-linear.

The embodiment of FIG. 3 also includes a third FM antenna segment 50 (F3) which extends generally horizontal and parallel with upper and lower FM antenna segments F1, F2.

Figure 4:
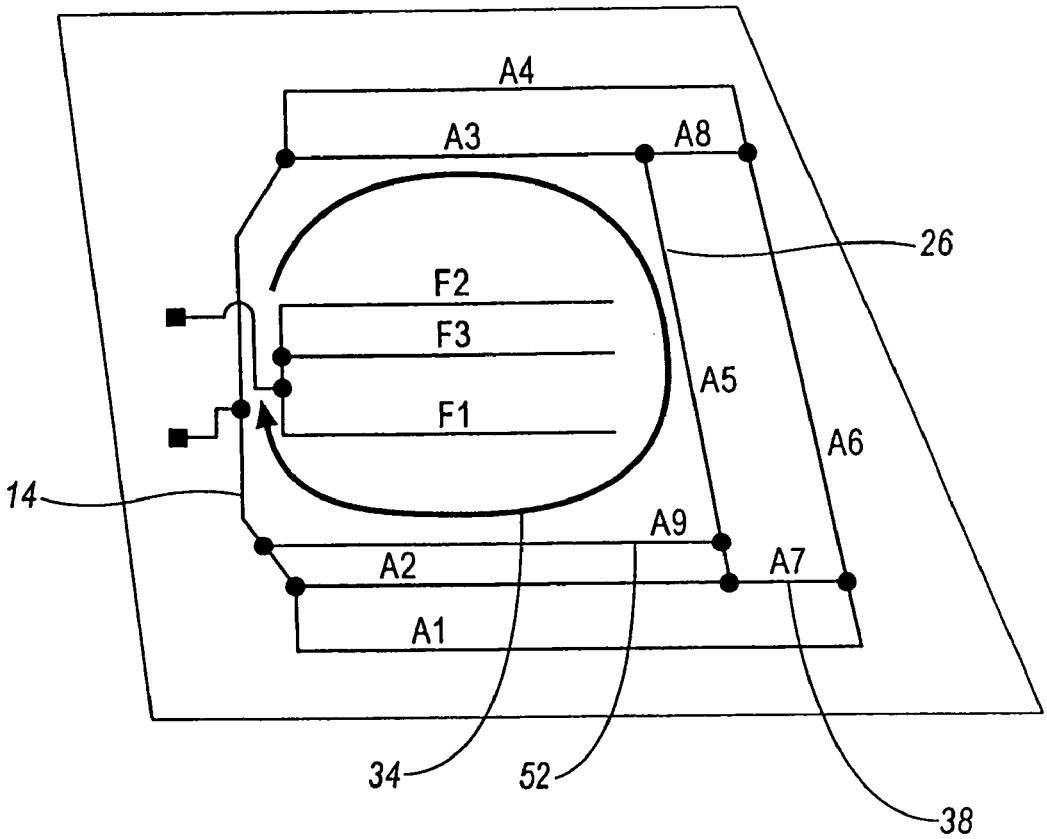
FIG. 4 is a third embodiment of the on-glass antenna of the present invention.

Now referring to FIG. 4, third embodiment is shown having all elements depicted in the embodiment of FIG. 3 but in addition thereto, a third jumper segment 52 is added to inner loop AM antenna 34. Specifically, third jumper segment 52 extends between generally vertical AM antenna connector segment 26 and first AM feed segment 14. Thus, segment 52 is connected in a parallel electrical circuit to segment A2. In all other ways, the embodiment of FIG. 4 is identical to the embodiment of FIG. 3.

Figure 5:
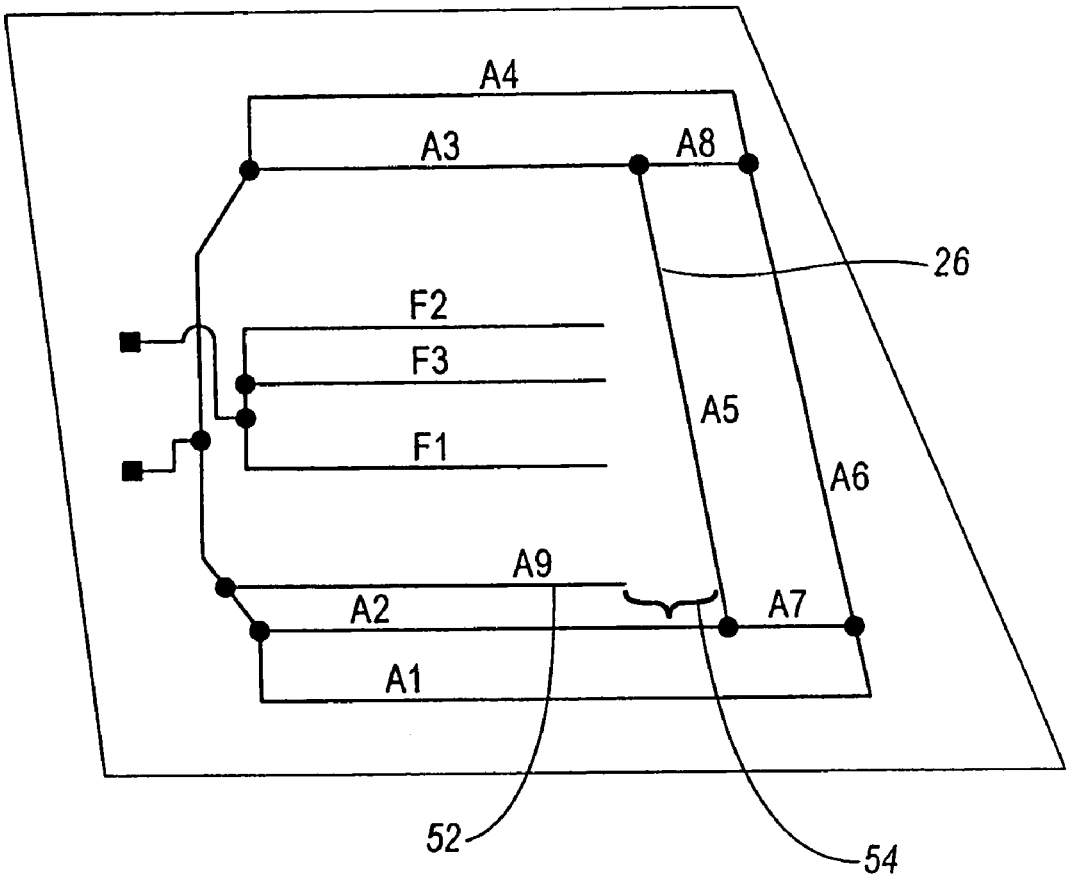
FIG. 5 is a fourth embodiment of the on-glass antenna of the present invention.

Now referring to FIG. 5, the fourth embodiment of the present invention is identical to the embodiment set forth in FIG. 4 except that floating segment 52 does not terminate at generally vertical AM antenna connector segment 26 but rather terminates 54 short of segment 26. In all other ways the embodiment set forth in FIG. 5 is identical to the embodiment of FIG. 4.

Figure 6:
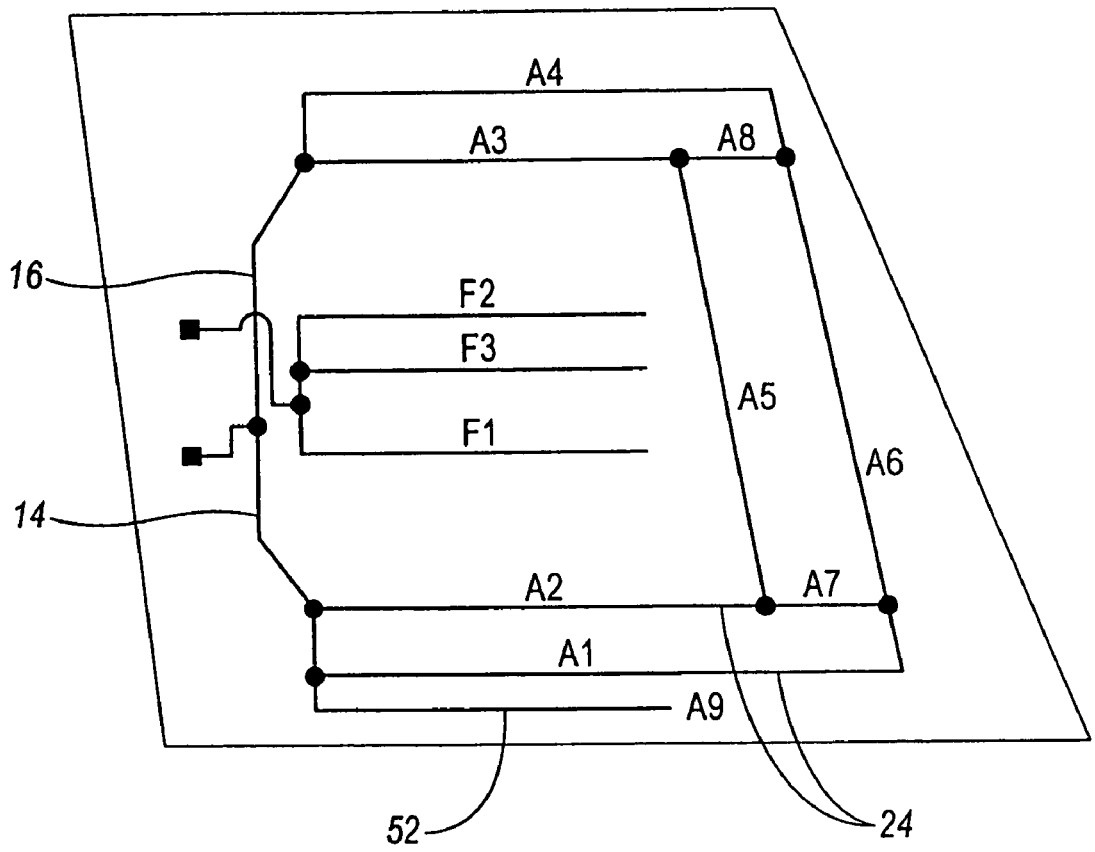
FIG. 6 is a fifth embodiment of the on-glass antenna of the present invention.

Now referring to FIG. 6, in the fifth embodiment of the on-glass antenna of the present invention, floating segment 52 is not contained within inner loop AM antenna 34 but rather resides outside of outer loop antenna 36 (16, A4, A6, A1 and 14). Floating segment 52 extends generally horizontally and generally parallel to lower AM antenna pair 24. In all other ways the embodiment of FIG. 6 is identical to that disclosed in FIG. 5.

Figure 7:
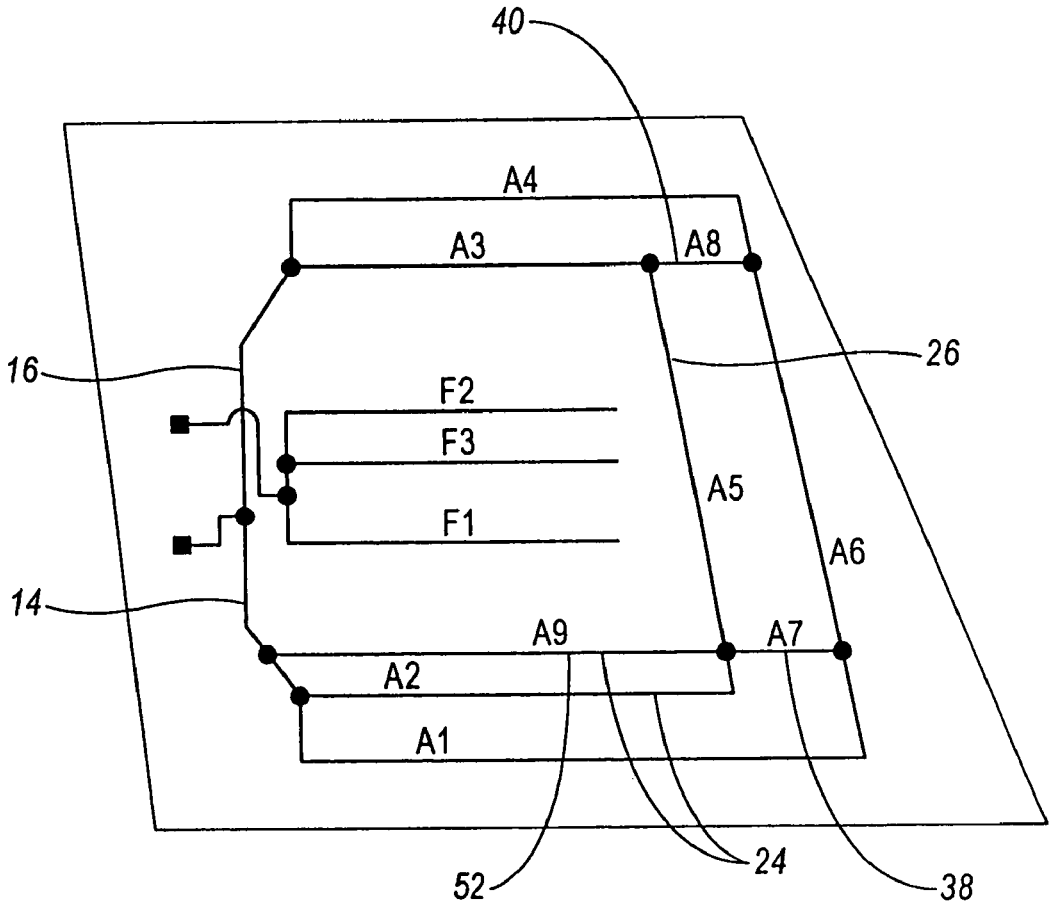
FIG. 7 is a sixth embodiment of the on-glass antenna of the present invention.

Now referring to FIG. 7, in a sixth embodiment of the on-glass antenna of the present invention is identical to the embodiment set forth in FIG. 4 except that in FIG. 7, first jumper segment 38 is co-linear with third jumper segment 52 (this is in contrast to the embodiment of FIG. 4 wherein first jumper segment 38 is co-linear with antenna segment A2).

All of the embodiments disclosed herein have a preferred range of antenna conductor width of 0.25 mm to 1.50 mm.

It is recognized that those skilled in the art may make various modifications or additions to the embodiments chosen here to illustrate the present invention, without departing from the spirit of the present invention. Accordingly, it is to be understood that the subject matter sought to be afforded protection hereby should be deemed to extend to the subject matter defined in the appended claims, including all fair equivalents thereof.

What is claimed as new and desired to be protected by Letters Patent of the United States is:

1. An antenna, comprising:

a first FM portion, a first AM portion at least partially circumscribing said first FM portion, a second AM portion at least partially circumscribing said first AM portion and at least partially circumscribing said first FM portion.

2. The antenna of claim 1, wherein said first FM portion includes first and second fork segments, wherein said first and second fork segments are generally parallel.

3. The antenna of claim 2, wherein said first and second fork segments share a second common antenna feed segment.

4. The antenna of claim 2, further including a third fork segment, wherein said first, second and third fork segments are generally parallel.

5. The antenna of claim 1, wherein said first and second AM portions share a first, common antenna feed segment.

6. The antenna of claim 1, wherein said first and second AM portions are loop antennas.

7. The antenna of claim 1, further including a first jumper segment connected between said first and second AM portions.

8. The antenna of claim 7, further including a second jumper segment connected between said first and second AM portions, wherein said first and second jumper segments are spaced apart.

9. The antenna of claim 7, wherein said first and second jumper segments are generally parallel to one another.

10. The antenna of claim 7, wherein said first AM portion includes at least one, generally straight segment, wherein said first jumper is generally co-linear with said at least one general straight segment.

11. The antenna of claim 1, wherein said first AM portion includes first, second, and third generally linear elements.

12. The antenna of claim 11, wherein said first AM portion further includes a fourth generally linear element, wherein one of said first, second or third elements is connected to said fourth linear element in a parallel electrical circuit.

13. The antenna of claim 12, further including a first generally linear jumper segment connected between said first and second AM portion, wherein said first jumper segment is generally co-linear to said fourth generally linear element.

14. The antenna of claim 12, further including a first generally linear jumper segment connected between said first and second AM portions, wherein said first jumper segment is generally co-linear with at least one of said first, second or third generally linear elements.

15. The antenna of claim 8, further including a floating segment at least partially circumscribed by said first AM portion, and wherein said floating segment has a first end terminating at said first AM portion and a second end which does not terminate at either said first FM portion, said first AM portion, or said second AM portion.

16. The antenna of claim 8, further including a floating segment which is not circumscribed, either partially or wholly by either of said first or second AM portions, and wherein said floating segment has a first end terminating at said second AM portion and a second end which does not terminate at either said first FM portion, said first AM portion, or said second AM portion.

17. The antenna of claim 15, wherein said first AM portion includes at least one generally straight segment, and wherein said floating segment is generally straight and generally parallel to said at least one generally straight segment of said first AM portion.

18. The antenna of claim 16, wherein said second AM portion includes at least one generally straight segment and wherein said floating segment is generally straight and generally parallel to said at least one generally straight segment of said second AM portion.

* * * * *